US006165666A

United States Patent [19]

Kariya

[11] Patent Number: 6,165,666

[45] Date of Patent: Dec. 26, 2000

[54] NON-MAGNETIC TONER INCLUDING COMPONENTS HAVING DIFFERENT MEAN GRAIN SIZES

[75] Inventor: Yoshinobu Kariya, Niigata, Japan

[73] Assignee: NEC Corporation, Tokyo, Japan

[21] Appl. No.: 09/304,590

[22] Filed: May 4, 1999

[30] Foreign Application Priority Data

May 7, 1998 [JP] Japan ..... 10-124718

[51] Int. Cl.[7] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 5,804,351 | 9/1998 | Takano et al. | 430/111 |
| 5,976,750 | 11/1999 | Hagi et al. | 430/111 |

FOREIGN PATENT DOCUMENTS

| | | |
|---|---|---|
| 55-6340 | 1/1980 | Japan . |
| 2-284150 | 11/1990 | Japan . |
| 4-177259 | 6/1992 | Japan . |
| 4-177260 | 6/1992 | Japan . |
| 6-202374 | 7/1994 | Japan . |
| 8-171229 | 7/1996 | Japan . |
| 9-62025 | 3/1997 | Japan . |

*Primary Examiner*—John Goodrow
*Attorney, Agent, or Firm*—Young & Thompson

[57] ABSTRACT

A non-magnetic toner having a single main ingredient without a carrier has two toner components having different mean grain sizes. The small-size toner component has a lower resistivity than the resistivity of the large-size toner component to achieve a stable mount of electrified charge and thus an excellent image quality during the printing using the toner.

18 Claims, No Drawings

NON-MAGNETIC TONER INCLUDING COMPONENTS HAVING DIFFERENT MEAN GRAIN SIZES

BACKGROUND OF THE INVENTION (a) Field of the Invention

The present invention relates to non-magnetic toner including toner components having different mean grain sizes and, more particularly, to a non-magnetic toner for use in an electrophotography, which is made of a mixture of toner components including particles having no carriers therein and different mean grain sizes.

(b) Description of the Related Art

In an electrophotographic printer using a non-magnetic toner having a single main ingredient without a carrier therein, the toner is generally electrified by rubbing operation using a doctor blade which attaches the toner particles to a developing roller by applying a contact pressure to the toner Such a non-magnetic toner contains a mixture of different toner components having different mean grain sizes. The mean grain size is generally represented in terms of grain diameter measured from the volume of toner particle and the number of toner particles or mean grain diameter measured from the actual size of each particle.

The non-magnetic toner including toner components having mean different grain sizes generally suffers from a difference in electrified charge between a particle having a larger grain size and a particle having a smaller grain size due to the difference in the surface area therebetween. In general, the smaller toner particles are electrified with larger electric charge per unit area compared to the larger toner particles. Thus, the smaller toner particles are attracted more firmly by the developing is roller due to larger mirroring force and accordingly pass by the doctor blade more easily compared to the larger toner particles irrespective of the contact pressure being applied between the doctor blade and the developing roller. As a result, the smaller toner particles are provided to the developer in an amount more than the amount of the larger toner particles in an initial stage of the printing using the toner. This fact, in addition to the larger electrified charge per unit area of the smaller toner particles, involves a phenomenon that the smaller toner particles are more used in development in the initial stage of the printing compared to the larger toner particles whereas the larger toner particles are more used with the progress of printing.

Accordingly, the resultant printed matter obtained in the initial stage has a sharp image and a low image density, and has a less sharp image and a higher image density with the progress of printing. Thus, uniform image quality is not obtained in the printed matter from the non-magnetic toner.

SUMMARY OF THE INVENTION

In view of the above, it is an object of the present invention to provide a non-magnetic toner having a single main ingredient without a carrier therein and including toner components having different mean grain sizes, which provides excellent image quality, such as in image density and resolution, to the printed matter due to stable electrified charge from the initial stage to the final stage of the printing using the toner.

The present invention provides a non-magnetic toner comprising a first toner component including having a first mean grain size, a first electric resistivity, and a second toner component mixed with said first toner component and having a main ingredient substantially identical to a main ingredient of said first toner component, said second toner component having a second mean grain size larger than said first mean grain size and a second electric resistivity higher than said first electric resistivity.

In accordance with the non-magnetic toner of the present invention, the difference in development rate between the first toner component having a smaller mean grain size and the second toner component having a larger mean grain size can be reduced by the electric resistivity of the first toner component which is lower than the electric resistivity of the second toner component.

The above and other objects, features and advantages of the present invention will be more apparent from the following description, referring to the accompanying drawings.

PREFERRED EMBODIMENTS OF THE INVENTION

Now, the present invention is more specifically described with reference to preferred embodiments thereof.

To equalize the electrified charge per unit area of the particles having a smaller mean grain size with that of the particles having a larger mean grain size, the present invention uses the configuration that the electric resistivity of the toner component having a smaller mean grain size is made lower than the electric resistivity of the toner component having a larger grain size. Several means can be used for obtaining the above configuration as follows:

(1) mixing the toner component having a smaller mean grain size with a conductive material such as metallic grains, carbon having a lower resistivity or a quasi-super conductivity;

(2) preparing the toner component having a smaller mean grain size from a low resistivity material such as phenol resin as a binder resin; and (3) making a difference in an amount of carbon used as a colorant between the toner component having a smaller mean grain size and the toner component having a larger mean grain size. This is achieved by, for example, adding 8 weight parts of carbon to the toner component having a smaller grain size and adding 4 weight parts of carbon to the toner component having a larger mean grain size.

To assure the advantages of the non-magnetic toner according to the present invention, several toner samples were prepared as examples of the present invention and subjected to evaluation of the image quality in the printed matter obtained using the toner samples.

EXAMPLE 1

Example 1 of the non-magnetic toner of the present invention was prepared as detailed below. Both the toner component having a smaller mean grain size (referred to as small-grain toner component hereinafter) and the toner component having a larger mean grain size (referred to as large-grain toner component) are added with internal additives including polyester resin as a binder resin, carbon black as a colorant, polyolefine wax as a releasing agent, and auriferous azo dye as a charge control agent. Both the components are also added with hydrophobic colloidal silica as an external additive.

The toner components included, per 100 weight parts of binder resin, 2 weight parts of wax, 9 weight parts of colorant, 2 weight parts of charge control agent. In addition, the small-grain toner component included 8 parts of carbon, whereas the large-grain toner component included 4 weight parts of carbon, per 100 weight parts of binder resin. Further, the toner included 1.4 weight percents of colloidal silica as an external additive.

Both the toner components were prepared by a well-known pulverization technique. The small-size toner component was prepared as follows:

(1) all the materials were weighed and received in a mixer for mixing for a specified time, then the resultant mixture were taken out;

(2) the mixture was kneaded by a extrusion-kneading machine, the kneaded mixture was then cooled by a cooling conveyer, and subjected to pulverization in a coarse pulverization machine;

(3) the coarse-pulverized composite was subjected to selection using a 1-mm-mesh screen, then the screened composite was introduced in a fine pulverization machine in which the mean grain diameter for the fine grains as measured from volume is set at 7.5 $\mu$m;

(4) the fine grains were then collected and received in an external adder for external addition with silica for a specified time; and (5) the fine grains added with silica were collected from the external adder and screened for removal of the toner agglomerations generated during the external addition.

The large-grain toner component was prepared similarly to the small-grain toner component except that the setting of the fine pulverization machine was 10 $\mu$m for the mean grain diameter as measured from volume. The small-grain toner component and the large-grain toner component thus prepared were mixed at a weight ratio of 1:1 to thereby prepare Example 1 of the non-magnetic toner of the present invention having therein no carrier.

It will be understood that Example 1 was prepared by the technique described in item (3) at the beginning of Description of the Preferred Embodiments in this text, wherein the amount of carbon in the toner components is controlled. The toner thus prepared had a printing ability of 10,000 sheet, and was used in a 18-ppm printer (having a printing speed of 18 sheets per minute). The toner exhibited a stable amount of electrified charge, and thus an excellent image quality during printing 10,000 sheets from an initial service stage to a final service stage of the printing using the toner substantially without a change of the image quality.

On the other hand, a comparative example of the conventional toner prepared similarly to Example 1 except for the amount of added carbon, which was 6 weight parts for both the toner components, exhibited a poor image quality during the printing, namely, a weak image density in the initial stage, and an increase in the image density to a sufficient level and decrease in the sharpness of the image with the progress of printing. Another comparative example of non-magnetic toner, wherein the amounts of resin and carbon were similar to those in Example 1 and only the large-grain toner component was added with metallic particles (i.e., 10 weight parts of iron oxide) as an internal additive, exhibited a poor image during the printing, i.e., a weak image density in the initial stage without increase in the image density with the progress of printing, and poor sharpness.

Another comparative example prepared similarly to Example 1, except that both the toner components included 10 weight parts of added carbon based on a conventional technique, exhibited a weak image density in the initial stage, and an increase in the image density, a decrease in sharpness and an increase of smear with the progress of the printing.

EXAMPLE 2

Example 2 of the toner according to the present invention had a composition similar to that of Example 1 except for metallic particles (30 weight parts of iron oxide) added to the small-size toner component, without addition thereof to the large-size toner component. The non-magnetic toner thus prepared exhibited, in the printing similar to that for Example 1, a stable amount of electrified charge and thus an excellent image quality, during printing 10,000 sheets from the initial stage to the final stage, substantially without a change in the image quality.

EXAMPLE 3

Example 3 of the toner according to the present invention had a composition similar to Example 1 except for addition of metallic particles (15 weight parts of silver) to the small-size toner component, without addition thereof to the large-size toner component. The non-magnetic toner thus prepared exhibited, in the printing similar to that for Example 1, a stable amount of electrified charge and an excellent image quality, during printing 10,000 sheets from the initial stage to the final stage, substantially without a change in the image quality.

EXAMPLE 4

Example 4 of the toner according to the present invention had a composition similar to Example 1 except for addition of 3 weight parts of carbon to the large-size toner component and 9 weight parts of carbon to the small-size toner component in this example. The non- magnetic toner thus prepared exhibited, in the printing similar to that for Example 1, a stable amount of electrified charge and an excellent image quality, during printing 10,000 sheets from the initial stage to the final stage, substantially without a change in the image quality.

EXAMPLE 5

Example 5 of the toner according to the present invention had a composition similar to Example 1 except for phenol resin used as a binder resin for the small-size toner component in this example. The non-magnetic toner thus prepared exhibited, in the printing similar to that for Example 1, a stable amount of electrified charge and an excellent image quality during printing 10,000 sheets from the initial stage to the final stage, substantially without a change in the image quality. In this example, it was considered that further improvement might be possible by controlling the resistivity of the toner.

EXAMPLE 6

Example 6 of the toner according to the present invention had a composition similar to Example 1 except for addition of external additive after mixing both the large-size toner component and the small-size toner component in this example. The non-magnetic toner thus prepared exhibited, in the printing similar to that for Example 1, a stable amount of electrified charge and thus an excellent image quality, during printing 10,000 sheets from the initial stage to the final stage, substantially without a change in the image quality. In this example, reduction of cost could be achieved by addition of the external additive to the mixture of both the components compared to the case of addition of the external additive separately to the small-size toner component and the large-size toner component.

EXAMPLE 7

Example 7 of the toner according to the present invention had a composition similar to Example 1 except for addition of 0.2 weight percents of alumina as an external additive in this example in addition to the external additive of silica. The non-magnetic toner thus prepared exhibited, in the printing similar to that for Example 1, a stable amount of electrified charge and thus an excellent image quality during printing 10,000 sheets from the initial stage to the final stage, substantially without a change in the image quality. In this example, background smear is reduced compared to the case wherein alumina was not added as the external additive.

As described above, the non-magnetic toner according to the present invention exhibits a stable amount of electrified charge from the initial printing stage to the final printing stage after printing a maximum number of sheets that the printer treats with the toner. Thus, the non-magnetic toner according to the present invention achieves an excellent image quality such as in image density and resolution with the progress of printing.

Since the above embodiments are described only for examples, the present invention is not limited to the above embodiments and various modifications or alterations can be easily made therefrom by those skilled in the art without departing from the scope of the present invention.

What is claimed is:

1. A non-magnetic toner comprising a first toner component having a first mean grain size and a first electric resistivity, and a second toner component mixed with said first toner component and having a main ingredient substantially identical to a main ingredient of said first toner component, said second toner component having a second mean grain size larger than said first mean grain size and a second electric resistivity higher than said first electric resistivity.

2. The non-magnetic toner as defined in claim 1, wherein said first toner component includes an electric conductive material as an additive.

3. The non-magnetic toner as defined in claim 2, wherein said electric conductive material is at least one of metallic grains and carbon.

4. The non-magnetic toner as defined in claim 1, wherein said first toner component includes a binder resin having a lower electric resistivity than an electric resistivity of a binder resin of said second toner component.

5. The non-magnetic toner as defined in claim 4, wherein said first toner component includes phenol resin as said binder resin.

6. The non-magnetic toner as defined in claim 1, wherein said first toner component includes a colorant in an amount larger than an amount of colorant of said second toner component.

7. The non-magnetic toner as defined in claim 6, wherein said colorant includes carbon.

8. The non-magnetic toner as defined in claim 1, wherein said toner components include no carrier therein.

9. A non-magnetic toner comprising:

a small-grain toner component having a first electrified charge per unit surface area; and a large-grain toner component having the first electrified charge per unit surface area, said small-grain toner component having a mean grain size less than said large-grain toner component, wherein said small-grain toner component and said large-grain toner component comprise an equal weight part of a binder resin, a wax, a colorant, a charge control agent, and a first external additive, and wherein conductive material is presented in said small-grain toner component in at least a 2:1 weight ratio to a presence of any of said conductive material in said large-grain toner component.

10. The non-magnetic toner of claim 9, wherein the colorant is carbon black and the conductive material is carbon.

11. The non-magnetic toner of claim 10, wherein the carbon present in said small-grain toner component is in a 3:1 weight ratio to the presence of the carbon in said large-grain toner component.

12. The non-magnetic toner of claim 9, wherein the conductive material in said small-grain toner component is iron oxide.

13. The non-magnetic toner of claim 9, wherein the conductive material in said small-grain toner component is silver.

14. The non-magnetic toner of claim 9, wherein said first external additive is silica and further comprising alumina as a second external additive.

15. The non-magnetic toner of claim 9, wherein the conductive material in said small-grain toner component is a metallic grain.

16. A non-magnetic toner comprising:

a small-grain toner component having a first electrified charge per unit surface area and a first resin binder; and a large-grain toner component having the first electrified charge per unit surface area and a second resin binder, said small-grain toner component having a mean grain size less than said large-grain toner component, wherein said small-grain toner component and said large-grain toner component comprise an equal weight part of a wax, a colorant, a charge control agent, and a first external additive.

17. The non-magnetic toner of claim 16, wherein the first resin binder is a phenol resin and the second resin binder is a polyester.

18. The non-magnetic toner of claim 17, wherein the small-grain toner component has a mean grain diameter of 7.5 microns and the large-grain toner component has a mean grain diameter of 10 microns.

* * * * *